United States Patent [19]

Stark, Sr.

[11] Patent Number: 4,969,219

[45] Date of Patent: Nov. 13, 1990

[54] AIRLIFT BULKHEAD

[76] Inventor: Robert Stark, Sr., 735 NE. 198th, Seattle, Wash. 98155

[21] Appl. No.: 484,435

[22] Filed: Feb. 16, 1990

Related U.S. Application Data

[63] Continuation of Ser. No. 251,903, Sep. 30, 1988, abandoned.

[51] Int. Cl.[5] ..... E04H 4/14

[52] U.S. Cl. ..... 4/505; 4/496

[58] Field of Search ..... 4/495–497, 4/505, 506; 272/4; 52/169.7, 243.1

[56] References Cited

U.S. PATENT DOCUMENTS

| | | | |
|---|---|---|---|
| 3,172,166 | 3/1965 | Imbrecht | 52/243.1 X |
| 3,453,790 | 7/1969 | Harris | 52/243.1 X |
| 3,582,999 | 6/1971 | Baker | 4/505 |
| 3,842,484 | 10/1974 | Stark . | |
| 3,935,599 | 2/1976 | Stark . | |
| 3,962,735 | 6/1976 | Davidson | 4/505 |
| 4,292,696 | 10/1981 | Berger | 4/496 X |
| 4,574,404 | 3/1986 | Stark, Sr. . | |
| 4,619,095 | 10/1986 | Johnston | 52/243.1 X |

*Primary Examiner*—Charles E. Phillips

*Attorney, Agent, or Firm*—Seed and Berry

[57] ABSTRACT

A swimming pool bulkhead is provided with sets of transversely spaced buoyancy chambers for providing stability against rotation about the lengthwise axis of the bulkhead when the chambers are inflated. The bulkhead is made of two separate short sections which are transported separately and bolted together at the pool.

22 Claims, 3 Drawing Sheets

FIG. 1
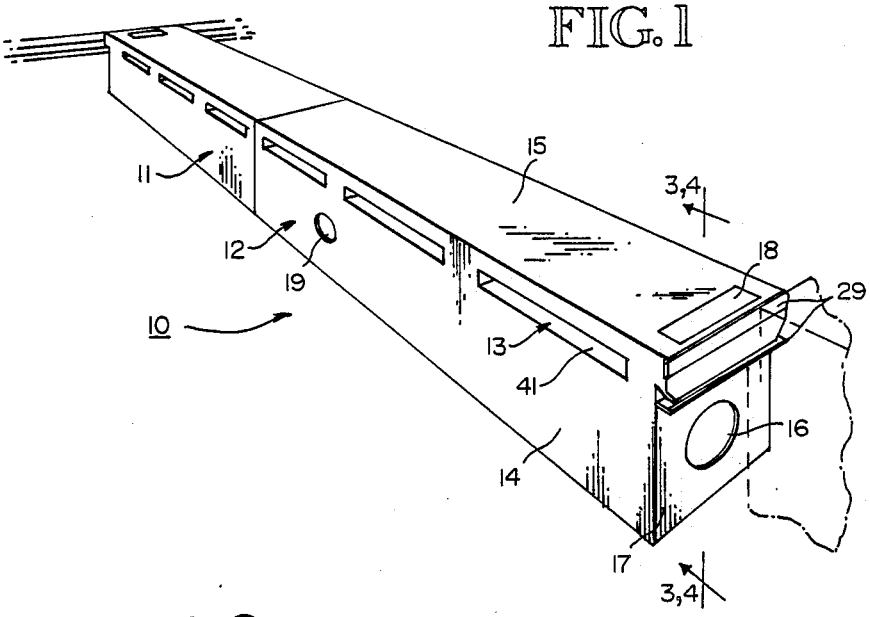
FIG. 2
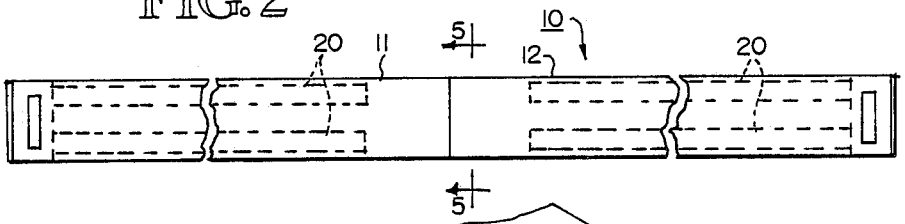
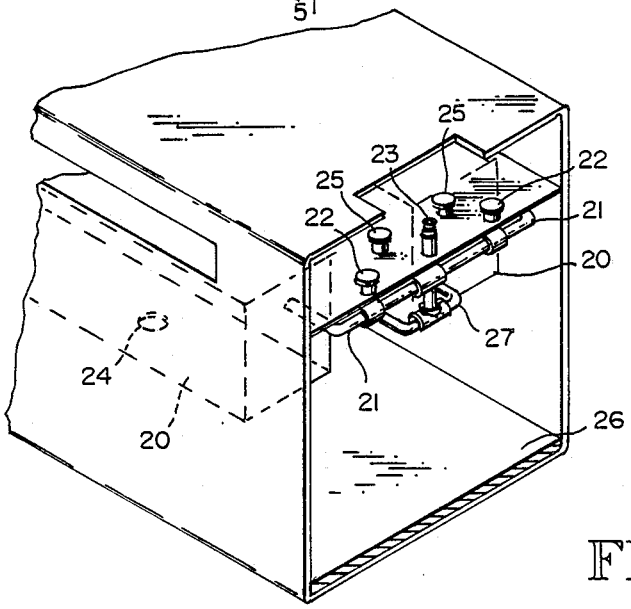
FIG. 3

AIRLIFT BULKHEAD

CROSS-REFERENCE TO RELATED APPLICATION

This application is a continuation of U.S. Pat. Application Ser. No. 07/251,903 filed Sept. 30, 1988, now abandoned.

TECHNICAL FIELD

The present invention relates to swimming pool bulkheads in general and, in particular, to a submersible swimming pool bulkhead which utilizes buoyancy chambers for stabilization and movement. In addition, the invention relates to methods and apparatus for transporting and installing extremely long swimming pool bulkheads.

BACKGROUND OF THE INVENTION

Movable bulkheads for swimming pools have been constructed of a variety of materials, such as aluminum, stainless steel or fiberglass, and have been equipped with wheels which ride upon the channel or deck of a pool to provide the bulkhead with mobility. Stark discloses in U.S. Pat. No. 3,935,599 a movable swimming pool bulkhead with end rollers to allow movement. Stark also discloses in U.S. Pat. No. 3,842,484 a method of constructing a movable swimming pool bulkhead. Conventional bulkheads which employ wheels for movement, however, are sometimes difficult to move in the pool.

Swimming pool bulkheads frequently may be moved in the pool for cleaning and for dividing the pool into various lengths. These bulkheads can be 75 feet in length and are very heavy. To assist in moving the bulkhead in the pool, Stark discloses in U.S. Pat. No. 4,574,404 a submersible swimming pool bulkhead which utilizes buoyancy chambers for movement. The length and weight of such a bulkhead, however, may make it difficult to move, and the bulkhead may tend to "tip" or rotate around the lengthwise axis of the bulkhead when in its buoyant and movable state.

Therefore, it is an object of the present invention to provide a swimming pool bulkhead that is more stable during movement. It is another object of the invention to provide buoyancy in a swimming pool bulkhead at opposite ends of the bulkhead and at transversely spaced locations so that the increased buoyancy occurs at separated locations for raising the bulkhead uniformly.

As mentioned above, swimming pool bulkheads can be over 75 feet in length. The normal allowable length for transporting a bulkhead on the highways without costly permits a warning vehicles is about 40 feet. Thus, transporting a long bulkhead can be expensive. In addition, long bulkheads are difficult to maneuver in covered pool facilities. Thus, it is also an object of the present invention to provide a swimming pool bulkhead that is more convenient to transport, construct and install.

It is another object of the invention to provide a method and apparatus for dividing a long bulkhead into sections and connecting the bulkhead sections at the pool site.

Other objects and advantages of the invention will become apparent upon reading the following detailed description and upon reference to the attached drawings.

DISCLOSURE OF THE INVENTION

Briefly stated, the present invention discloses a movable, submersible bulkhead for use in a swimming pool, comprised of an elongated, hollow body having top, bottom, side and end walls, two transversely separated air chambers extending substantially the length of the body, and an air control system for selectively controlling the quantity of air and water within the air chambers.

The invention provides for stable movement of the transversely extending bulkhead by selectively controlling the quantity of air and water within the air chambers to increase the buoyancy of the air chambers by displacing the water contained therein, moving the bulkhead to a new position within the pool, and subsequently decreasing the buoyancy of the air chambers by allowing water to enter the chambers.

In one embodiment of the present invention, the bulkhead is divided into two shorter sections, each shorter section having top, bottom, side, end and abutting walls, and two transversely separated air chambers extending substantially the length of each shorter section. The shorter sections are bolted together at the pool site to span the width of the pool.

BRIEF DESCRIPTION OF THE DRAWINGS

FIG. 1 is a perspective view of a bulkhead embodying the present invention.

FIG. 2 is a top plan view of the bulkhead of FIG. 1.

FIG. 3 is a perspective fragmentary cross-sectional view of the bulkhead taken along the line 3—3 of FIG. 1 showing part of an air chamber control system.

BEST MODE FOR CARRYING OUT THE INVENTION

Figure 4:
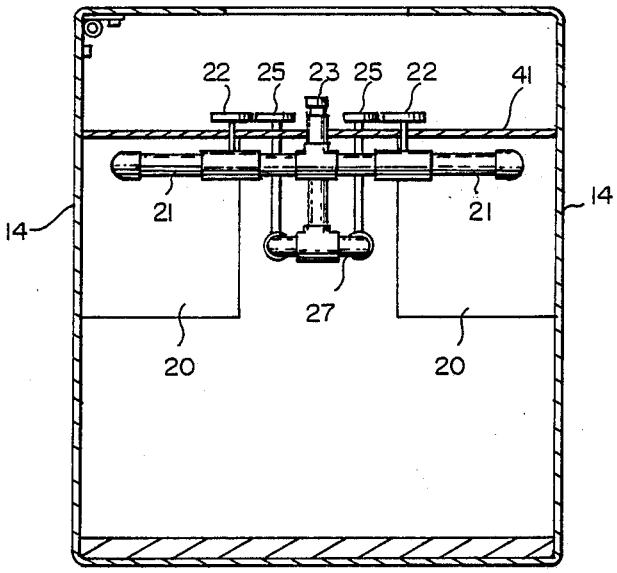
FIG. 4 is an end cross section of the bulkhead taken along line 4—4 of FIG. 1 showing the air chambers and part of the air control system.

Referring to FIG. 1, a movable, submersible bulkhead 10 is shown in its operative and stationary position. The bulkhead 10 of this embodiment consists of two shorter sections 11 and 12 which are rigidly attached along their abutting end walls. It can be readily appreciated that the bulkhead could consist of a single section alone or a plurality of shorter sections rigidly joined together.

The bulkhead 10 should preferably be composed of fiberglass, with all other materials being plastic, stainless steel or similar noncorrosive material. The bulkhead 10 is provided with a series of laterally extending slots 13 in its side wall 14, opening to a full length shelf 41, which act to dampen the wave action of the pool. In addition, the top surface 15 of the bulkhead 10 should preferably be of a textured, nonskid surface for safety considerations. It is also preferable to avoid the use of any rough edges, angles or openings that may hold or injure in any way the individuals using the pool in which the movable bulkhead 10 is placed. The bulkhead may be constructed to any variety of design specifications, including various colors and racing lane target configurations.

The bulkhead 10 contains an opening 16 in the end wall 17 to allow the free ingress and egress of water into and out of the interior of the bulkhead. Water within the interior adds stability to the bulkhead when it is in a submerged position. A door 18 is placed in the top surface of the bulkhead to allow access to the air valves located thereunder. The side wall 14 may contain an access port 19 to allow limited access to the interior of the bulkhead once in place.

Turning to FIG. 2, the bulkhead 10 is shown to contain a pair of transversely separated air chambers 20 extending substantially the length of each shorter section 11 and 12.

As shown in FIG. 3, air chambers 20 are fitted with plumbing 21 and valves 22, which communicate with air port 23 and which allow the air chambers to be filled or vacated of air. The air chambers 20 each contain at least one water inlet 24 which is in constant communication with the water of the pool and which permits water to enter or exit the air chambers. The air chambers of other sections of the bulkhead are similarly fitted with additional plumbing 27 and valves 25, which communicate with air port 23 and which allow the air chambers in shorter section 11 of FIG. 2 to be filled or vacated of air.

When it is necessary to move the bulkhead 10 from one location to another within the pool (for example, because of a specific distance requirement in a swimming race), the bulkhead is first unlocked from the side of the pool. For example, when bolts or pins are used for the purpose of locking the bulkhead in place, these are retracted to free the bulkhead for movement. Air is then injected into the air chambers 20 by connecting the air port 23 to an air supply and opening valves 22 and 25. As the air pressure within the air chambers increases, water is forced out of the air chambers 20 and into the interior compartment 26 of the bulkhead through the water inlets 24 in the bottom of each air chamber. Water forced into the interior compartment of the bulkhead may then exit the bulkhead through the openings on each end wall of the shorter sections. As the water is expelled from the air chambers, the bulkhead becomes more buoyant, releasing it from frictional contact with the side channel of the pool. The bulkhead may then be moved to a new position in the pool. Referring back to FIG. 1, the ends of the bulkhead may be provided with a set of plastic bumper strips 29, which guide and protect the bulkhead, as well as the pool, during movement.

By utilizing transversely separated air chambers that run substantially the length of each shorter section, the bulkhead is stable when the air chambers are filled with air. This prevents the buoyant bulkhead from "tipping" (i.e, rotating about the lengthwise axis of the bulkhead) during movement. When the bulkhead is in a new position, air within the air chambers 20 is allowed to exit through air port 23, thereby allowing water to reenter through the water inlet 24 of each air chamber. As the level of the water within the air chambers increases, the buoyancy necessary for movement is lost, allowing the bulkhead to submerge and come to rest on the side channels of the pool. The bulkhead may then be resecured by the extension of bolts or pins into appropriate receptors the side channels of the pool, as disclosed in U.S. Pat. No. 3,842,484.

Referring to FIG. 4, the shelf 41 extending the length of the bulkhead section is fixed to each side wall 14 defining the top of interior compartment 26 of the bulkhead. Air chambers 20 are fixed to the underside of the shelf 41 and to side walls 14. The air chambers are separated by a distance sufficient to provide a stable bulkhead when the bulkhead is in a buoyant and movable state, the vertical depth of the air chambers and their volume being sufficient to provide buoyancy to the bulkhead when the water contained therein is displaced with air.

Figure 5:
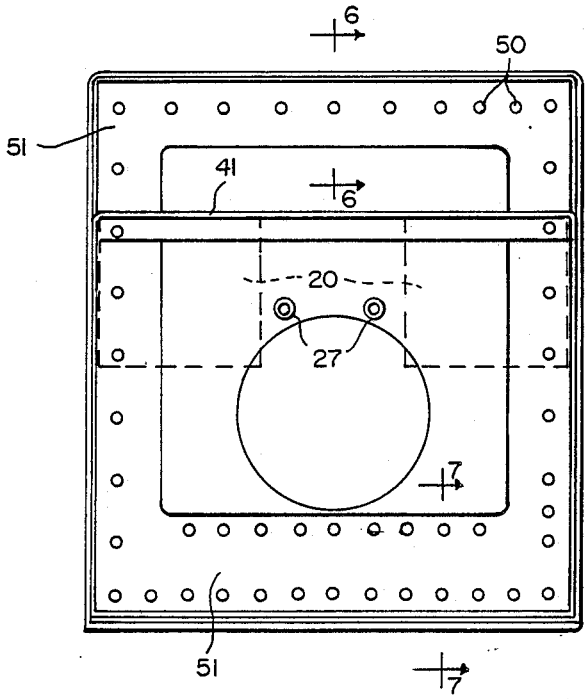
FIG. 5 is a cross section of the bulkhead taken along the line 5—5 of FIG. 2 showing the location of the bolts which rigidly attach the two shorter sections.
Figure 7:
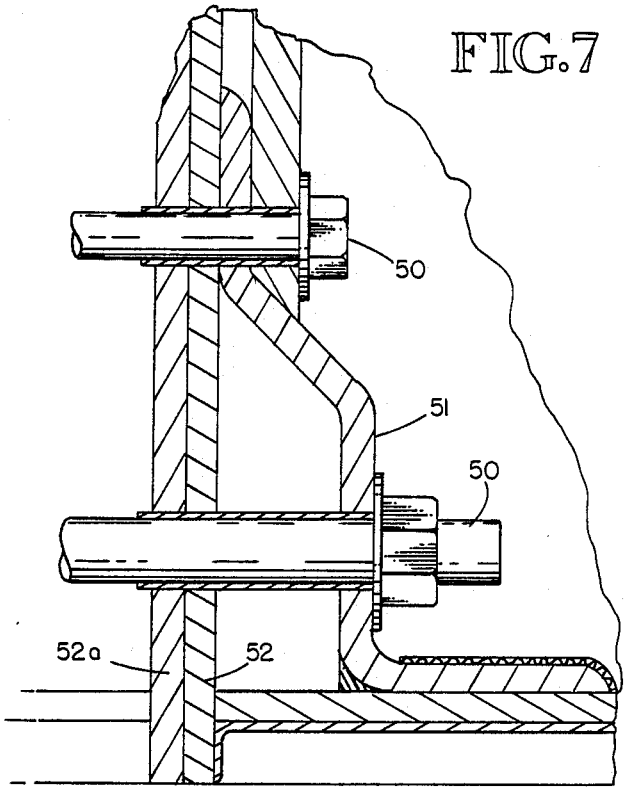
FIGS. 6 and 7 are fragmentary cross-sectional views of the bolts and reinforcement taken along the lines 6—6 and 7—7 of FIG. 5.
Figure 6:
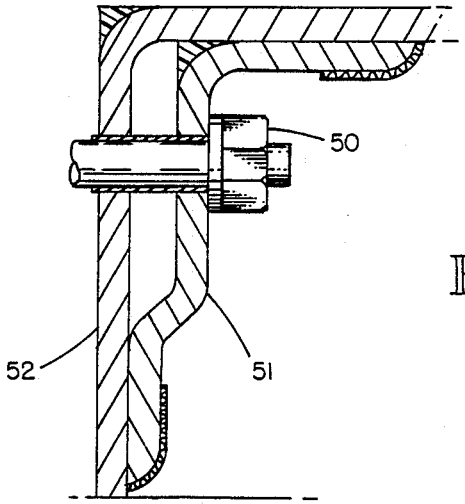

Turning to FIG. 5, a cross-sectional view of the abutting wall of each shorter section of the bulkhead is shown. Air lines 27 extend through the abutting walls. To rigidly attach the shorter sections, bolts 50 are used to secure the joining walls of each section. Metal supporting angle plates 51 are glassed in to secure the plates along the interior edge of the joining wall to supply rigid support to the connection. FIGS. 6 and 7 show an arrangement of bolts 50 and supporting plates 51 to assist in the connection of the joining walls 52 and **52*a*** of the respective shorter sections.

It is apparent that by utilizing shorter sections rather than a single bulkhead, transportation to a pool is greatly enhanced. Often, limits are placed on the length of materials that may be shipped by rail or truck. By utilizing shorter sections, bulkheads may be shipped in compliance with these length limits. In addition, installation at the pool site is simplified by permitting easier access to a pool building. That is, two or more smaller sections can be maneuvered through doors and around tight corners in places where one 75-foot bulkhead could not be installed. Once within the pool area, the sections are bolted together and the unitary bulkhead is then positioned in the pool.

While the preferred forms of the method and apparatus have been described and illustrated, variations will be readily apparent to one skilled in the art without departing from the principles of the invention. Accordingly, the invention is not to be limited to the embodiments described.

I claim:

1. A transversely movable, submersible bulkhead for use in a swimming pool, comprising:

an elongated, hollow body having top, bottom, end and side walls, said body having a longitudinal centerline extending from one end wall to the other end wall, said body having a shelf wall between the top and bottom walls and joining the side walls to form an interior compartment, said bulkhead containing an opening for providing ingress and egress of water into the interior compartment of the body;

a plurality of air chambers located in the interior compartment, the air chambers spaced transversely of the body and on opposite sides of the longitudinal centerline for providing a variable buoyancy force that is substantially uniform on opposite sides of the longitudinal centerline, said air chambers provided with a water inlet and a valve communicating with the interior of the air chambers for passing air into and out of the air chambers; and means for selectively controlling the quantity of air and water within the air chambers of the body by passing air through the valves to displace water within the air chambers.

2. The bulkhead of claim 1, said body including at least two axially aligned sections, each section having a plurality of air chambers.

3. The bulkhead as defined in claim 2 wherein said means for selectively controlling includes a pressurized gas inlet pipe communicating with said valves, and said water inlet includes at least one aperture freely communicating with both the interior compartment and the water in the pool.

4. The bulkhead as defined in claim 3, including air lines passing through one section and communicating with the air chambers of the other section.

5. The bulkhead as defined in claim 1, including means for guiding said bulkhead during movement.

6. The bulkhead as defined in claim 5 wherein said guide means includes a set of plastic bumper strips covering the bulkhead at the area of frictional contact between the bulkhead and the pool.

7. A movable, submersible bulkhead for use in a swimming pool, comprising:

a pair of elongated, hollow shorter sections having top, bottom, end, side and abutting walls, said shorter sections having a longitudinal centerline extending from the end wall to the abutting wall, said shorter sections having a shelf wall between the top and bottom walls and joining the side walls to form an interior compartment, said bulkhead containing an opening in the walls for providing ingress and egress of water into the interior compartment of the shorter sections, said shorter sections being rigidly but removably attached along their abutting walls;

a set of transversely separated air chambers located in the interior compartment and substantially extending the length of each shorter section, said air chambers spaced transversely of the shorter sections and on opposite sides of the longitudinal centerline for providing a variable buoyancy force that is substantially uniform on opposite sides of the longitudinal centerline, said air chambers provided with a water inlet and valve communicating with the interior of the air chambers for passing air into and out of the air chambers; and means for selectively controlling the quantity of air and water within air the chambers of each shorter section by passing air through the valves to displace water in the air chambers.

8. The bulkhead of claim 7, said abutting walls each including strengthening plates secured to the periphery of the abutting walls and means for bolting the strengthening plates of abutting walls together to form a unitary bulkhead.

9. The bulkhead as defined in claim 7, including means for guiding said bulkhead during movement.

10. The bulkhead as defined in claim 9 wherein said guide means includes a set of plastic bumper strips covering the bulkhead at the area of frictional contact between the bulkhead and the pool.

11. A movable, submersible bulkhead for use in a swimming pool, comprising:

an elongated, hollow body having top, bottom, end and side walls, said body having a shelf wall between the top and bottom walls and joining the side and end walls to form an interior compartment, said bulkhead containing an opening for providing ingress and egress of water into the interior compartment of the body, said body having a longitudinal centerline extending from one end wall to the other end wall, said elongated hollow body adapted to be in frictional contact with horizontal surfaces along opposite sides of the swimming pool;

a set of air chambers in the interior compartment of the body, the air chambers spaced transversely of the body and on opposites sides of the longitudinal centerline for providing uniform buoyancy forces on opposite sides of the longitudinal centerline, said air chambers provided with a water inlet and valve communicating with the interior of the air chambers for passing air into and out of the air chambers; and means for selectively controlling the quantity of air and water within the air chamber by passing air through the valves to displace water within the air chambers to uniformly increase buoyancy on opposite sides of the longitudinal centerline for releasing the body from frictional contact with the horizontal surfaces along opposite sides of the swimming pool.

12. The bulkhead of claim 11 wherein said end walls are provided with means for guiding the bulkhead during movement.

13. The bulkhead of claim 12 wherein said guide means includes a set of plastic bumper strips covering the bulkhead at the area of frictional contact between the body and the pool.

14. The bulkhead of claim 11 wherein said means for selectively controlling the quantity of air and water within the air chambers includes a pressurized gas inlet pipe communicating with said valves, and said water inlet includes at least one aperture freely communicating with both the interior compartment of the body and the water in the pool.

15. A movable, submersible bulkhead for use in a swimming pool, comprising:

a pair of elongated, hollow shorter sections having top, bottom, end, side and abutting walls, said sections having a shelf wall between the top and bottom walls and joining the side, end and abutting walls to form an interior compartment, said bulkhead containing an opening for providing ingress and egress of water into the interior compartment of each shorter section, said sections being rigidly and removably attached along their abutting walls, said sections having a longitudinal length and a shorter transverse width, said sections having a longitudinal centerline extending from the end wall to the abutting wall, said pair of elongated, shorter sections when attached along their abutting walls adapted to be in frictional contact with horizontal surfaces along opposite sides of the swimming pool;

a set of air chambers in the interior compartment of each of said sections and extending parallel to the longitudinal length of the sections, said air chambers separated transversely of the sections and spaced equidistantly on opposite sides of the sections for providing uniform buoyancy forces on opposite sides of the longitudinal centerline, said air chambers provided with a water inlet and valve communicating with the interior of the air chambers for passing air into and out of the air chambers; and means for selectively controlling the quantity of air and water within the air chambers of said sections by passing air through the valves to displace water within the air chambers to uniformly increase buoyancy on opposite sides of the longitudinal centerline for releasing the sections from frictional contact with the horizontal surfaces along opposite sides of the swimming pool.

16. The bulkhead of claim 15 wherein said end walls are provided with means for guiding the bulkhead during movement.

17. The bulkhead of claim 16 wherein said guide means includes a set of plastic bumper strips covering the bulkhead at the area of frictional contact between the attached sections and the pool.

18. The bulkhead of claim 15 wherein said means for selectively controlling the quantity of air and water within the air chambers includes a pressurized gas inlet pipe communicating with said valves, and said water inlet includes at least one aperture freely communicating with both the interior compartment of each section and the water in the pool.

19. A movable, submersible bulkhead for use in a swimming pool, comprising:

a plurality of elongated, hollow shorter sections having top, bottom, end and side walls, said sections having a shelf wall between the top and bottom walls and joining the side and end walls to form an interior compartment, said bulkhead containing an opening for providing ingress and egress of water into the interior compartment of each shorter section, said sections being rigidly and removably attached along their end walls, said sections having a longitudinal length and a shorter transverse width, said plurality of elongated, shorter sections when attached along their end walls having a longitudinal centerline and adapted to be in frictional contact with horizontal surfaces along opposite sides of the swimming pool;

a set of air chambers in the interior compartment of said sections and extending parallel to the longitudinal length of the sections, said air chambers separated transversely of the sections and spaced equidistantly on opposite sides of the longitudinal centerline for providing uniform buoyancy forces on opposite sides of the longitudinal centerline, said air chambers provided with a water inlet and valve communicating with the interior of the air chambers for passing air into and out of the air chambers; and means for selectively controlling the quantity of air and water within the air chambers of said sections by passing air through the valves to displace water within the air chambers to uniformly increase buoyancy on opposite sides of the longitudinal centerline for releasing the sections from frictional contact with the horizontal surfaces along opposite sides of the swimming pool.

20. The bulkhead of claim 19 wherein said end walls in frictional contact with the sides of the pool are provided with means for guiding the bulkhead during movement.

21. The bulkhead of claim 20 wherein said guide means includes a set of plastic bumper strips covering the bulkhead at the area of frictional contact between the attached sections and the pool.

22. The bulkhead of claim 19 wherein said means for selectively controlling the quantity of air and water within the air chambers includes a pressurized gas inlet pipe communicating with said valves, and said water inlet includes at least one aperture freely communicating with both the interior compartment of each section and the water in the pool.

* * * * *